US011175621B2

(12) United States Patent
Cavill et al.

(10) Patent No.: US 11,175,621 B2
(45) **Date of Patent: *Nov. 16, 2021**

(54) REPLACEABLE UNITS OF AN ELECTROPHOTOGRAPHIC IMAGE FORMING DEVICE HAVING A SHIPPING OR STORAGE SEPARATOR

(71) Applicant: LEXMARK INTERNATIONAL, INC., Lexington, KY (US)

(72) Inventors: Gregory Alan Cavill, Winchester, KY (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/088,841

(22) Filed: Nov. 4, 2020

(65) Prior Publication Data

US 2021/0200142 A1 Jul. 1, 2021

Related U.S. Application Data

(60) Provisional application No. 62/954,090, filed on Dec. 27, 2019, provisional application No. 63/000,828, filed on Mar. 27, 2020.

(51) Int. Cl.

| | |
|---|---|
| ***G03G 21/16*** | (2006.01) |
| ***G03G 21/18*** | (2006.01) |
| ***G03G 15/08*** | (2006.01) |

(52) U.S. Cl.

CPC ..... *G03G 21/1676* (2013.01); *G03G 15/0865* (2013.01); *G03G 21/168* (2013.01); (Continued)

(58) Field of Classification Search

CPC ..... G03G 15/0865; G03G 21/1647; G03G 21/1676; G03G 21/181; G03G 21/1821; (Continued)

(56) References Cited

U.S. PATENT DOCUMENTS

| | | | |
|---|---|---|---|
| 5,802,432 | A | 9/1998 | Coffey et al. |
| 6,678,489 | B1 | 1/2004 | Carter et al. |

(Continued)

OTHER PUBLICATIONS

U.S. Appl. No. 17/088,831, filed Nov. 4, 2020 (Cavill et al.).

*Primary Examiner* — Sophia S Chen
(74) *Attorney, Agent, or Firm* — Justin M. Tromp

(57) ABSTRACT

A toner cartridge according to one embodiment includes a body having a reservoir for storing toner and a rotatable developer roll mounted on the body and in fluid communication with the reservoir. A portion of an outer surface of the developer roll is exposed along a front of the body for supplying toner from the reservoir to a corresponding photoconductive drum on an imaging unit when the toner cartridge is installed on the imaging unit in an operative position of the toner cartridge relative to the imaging unit. A first engagement member positioned on a rear of the body is configured to engage a corresponding second engagement member on the imaging unit when the toner cartridge is installed on the imaging unit to retain the toner cartridge in a storage position of the toner cartridge relative to the imaging unit with the developer roll spaced away from the photoconductive drum.

17 Claims, 9 Drawing Sheets

(52) U.S. Cl.
CPC ..... *G03G 21/1647* (2013.01); *G03G 21/181* (2013.01); *G03G 21/1846* (2013.01)

(58) Field of Classification Search
CPC ..... G03G 21/1846; G03G 2221/1651; G03G 2221/1846; G03G 2221/1853; G03G 21/168
See application file for complete search history.

(56) References Cited

U.S. PATENT DOCUMENTS

| | | | | |
|---|---|---|---|---|
| 6,871,031 | B2 | 3/2005 | Blaine et al. | |
| 7,983,595 | B2 | 7/2011 | Dickerson et al. | |
| 8,210,530 | B1 | 7/2012 | Gayne et al. | |
| 8,301,057 | B2 | 10/2012 | Agnissey et al. | |
| 8,348,273 | B2 | 1/2013 | Gayne et al. | |
| 8,867,966 | B2 | 10/2014 | Acosta et al. | |
| 8,867,970 | B2 | 10/2014 | Acosta et al. | |
| 10,809,661 | B1 | 10/2020 | Carpenter et al. | |
| 2007/0138732 | A1 | 6/2007 | Hackney | |
| 2008/0138109 | A1* | 6/2008 | Anan ..... | G03G 21/1821 399/113 |
| 2013/0051844 | A1* | 2/2013 | Shinoya ..... | G03G 21/1842 399/111 |
| 2016/0077485 | A1 | 3/2016 | Sproul | |
| 2019/0227482 | A1* | 7/2019 | Koguchi ..... | G03G 21/1647 |
| 2020/0272094 | A1* | 8/2020 | Matsumoto ..... | G03G 21/1821 |

* cited by examiner

REPLACEABLE UNITS OF AN ELECTROPHOTOGRAPHIC IMAGE FORMING DEVICE HAVING A SHIPPING OR STORAGE SEPARATOR

CROSS REFERENCES TO RELATED APPLICATIONS

This application claims priority to U.S. Provisional Patent Application Ser. No. 62/954,090, filed Dec. 27, 2019, entitled "Toner Cartridge Separator," and to U.S. Provisional Patent Application Ser. No. 63/000,828, filed Mar. 27, 2020, entitled "Shipping or Storage Separator for Replaceable Units of an Electrophotographic Image Forming Device," the contents of which are hereby incorporated by reference in their entirety.

BACKGROUND

1. Field of the Disclosure

The present disclosure relates generally to image forming devices and more particularly to a shipping or storage separator for replaceable units of an electrophotographic image forming device.

2. Description of the Related Art

Electrophotographic image forming devices commonly include one or more replaceable units that have a shorter useful life than the image forming device. The replaceable unit(s) must be replaced periodically by the user in order to continue printing. For example, an electrophotographic image forming device's main toner supply is typically stored in a replaceable unit, sometimes referred to as a toner cartridge. In some devices, other imaging components such as a developer roll, a toner adder roll, a doctor blade, a photoconductive drum and a charge roll are included in the toner cartridge that holds the main toner supply. In other devices, some or all of these imaging components are separated from the toner supply in one or more separate replaceable units, sometimes referred to as imaging units. In these devices, the toner cartridge supplies toner from the main toner supply to the imaging unit(s) permitting the imaging components of the imaging unit(s) to perform a print operation. The toner cartridge is typically replaced more frequently than the imaging unit(s) since the toner supply is consumed relatively quickly in comparison with the expected life of the components housed in the imaging unit(s).

Some of the components that are biased against the photoconductive drum during operation of the image forming device (e.g., the developer roll) may tend to chemically damage or physically deform or flatten portions of the photoconductive drum if the components are maintained in unmoved contact with the photoconductive drum for a long period of time, such as during storage or shipping. Similarly, the components that are biased against the photoconductive drum may also be damaged (e.g., developer roll compression set issues) by prolonged, unmoved contact with the photoconductive drum. This damage to the photoconductive drum and other components may, in turn, cause print defects. To address this issue, replaceable units having a photoconductive drum are generally stored and shipped with a separator component that physically separates the photoconductive drum from other imaging components. The separator component is then removed and discarded by the customer before installation of the replaceable unit into the image forming device.

An improved shipping or storage separator for use with replaceable units of an electrophotographic image forming device is desired.

SUMMARY

An imaging unit for use with a toner cartridge in an electrophotographic image forming device according to one example embodiment includes a frame defining a toner cartridge receiving area for receiving the toner cartridge and a rotatable photoconductive drum. A portion of the photoconductive drum is exposed along a front portion of the toner cartridge receiving area for receiving toner from a corresponding developer roll of the toner cartridge when the toner cartridge is installed on the frame of the imaging unit in the toner cartridge receiving area in an operative position of the toner cartridge relative to the imaging unit. A first engagement member is mounted to the frame. The first engagement member is moveable relative to the frame between a first position and a second position. In the first position, the first engagement member is configured to engage a corresponding second engagement member on the toner cartridge to retain the toner cartridge in a storage position of the toner cartridge relative to the imaging unit with the toner cartridge installed on the frame of the imaging unit in the toner cartridge receiving area and the developer roll of the toner cartridge spaced away from the photoconductive drum. In the second position, the first engagement member is configured to clear the second engagement member on the toner cartridge to permit installation of the toner cartridge on the frame of the imaging unit in the operative position of the toner cartridge relative to the imaging unit and to permit removal of the toner cartridge from the frame of the imaging unit.

An imaging unit for use with a toner cartridge in an electrophotographic image forming device according to another example embodiment includes a frame defining a toner cartridge receiving area for receiving the toner cartridge and a rotatable photoconductive drum. A portion of the photoconductive drum is exposed along a front portion of the toner cartridge receiving area for receiving toner from a corresponding developer roll of the toner cartridge when the toner cartridge is installed on the frame of the imaging unit in the toner cartridge receiving area in an operative position of the toner cartridge relative to the imaging unit. The frame includes a rear wall positioned along a rear portion of the toner cartridge receiving area. A handle is mounted to the rear wall and is pivotable about a pivot axis relative to the rear wall. The handle is positioned to permit a user to grasp the handle to assist with manual insertion of the imaging unit into the image forming device and manual removal of the imaging unit from the image forming device. The handle includes a first engagement member configured to engage a corresponding second engagement member on the toner cartridge to retain the toner cartridge in a storage position of the toner cartridge relative to the imaging unit with the toner cartridge installed on the frame of the imaging unit in the toner cartridge receiving area and the developer roll of the toner cartridge spaced away from the photoconductive drum.

A toner cartridge for use with an imaging unit in an electrophotographic image forming device according to one example embodiment includes a body having a reservoir for storing toner. A rotatable developer roll is mounted on the body and is in fluid communication with the reservoir. A portion of an outer surface of the developer roll is exposed along a front of the body for supplying toner from the reservoir to a corresponding photoconductive drum on the imaging unit when the toner cartridge is installed on the imaging unit in an operative position of the toner cartridge relative to the imaging unit. A first engagement member is positioned on a rear of the body. The first engagement member is configured to engage a corresponding second engagement member on the imaging unit when the toner cartridge is installed on the imaging unit to retain the toner cartridge in a storage position of the toner cartridge relative to the imaging unit with the developer roll of the toner cartridge spaced away from the photoconductive drum of the imaging unit.

A toner cartridge for use with an imaging unit in an image forming device according to another example embodiment includes a body having a top, a bottom, a front and a rear positioned between a first side and a second side of the body. The body has a reservoir for holding toner. A rotatable developer roll is mounted on the body and is in fluid communication with the reservoir. A portion of an outer surface of the developer roll is exposed along the front of the body for supplying toner from the reservoir to a corresponding photoconductive drum on the imaging unit when the toner cartridge is installed on the imaging unit in an operative position of the toner cartridge relative to the imaging unit. A first alignment guide extends outward from the first side of the body, and a second alignment guide extends outward from the second side of the body for positioning the toner cartridge on the imaging unit. The first and second alignment guides are spaced above the developer roll along the front of the body. The first and second alignment guides define a pivot axis about which the toner cartridge is pivotable relative to the imaging unit when the toner cartridge is installed on the imaging unit. An angled contact surface on the rear of the body faces upward and rearward for contacting a corresponding hold-down on the imaging unit and receiving a bias force from the corresponding hold-down on the imaging unit for biasing the toner cartridge about the pivot axis when the toner cartridge is installed on the imaging unit in the operative position of the toner cartridge relative to the imaging unit. A rib is positioned on the rear of the body. The rib protrudes outward away from the rear of the body and is spaced above the angled contact surface. The rib is configured to mate with a corresponding slot on the imaging unit when the toner cartridge is installed on the imaging unit to retain the toner cartridge in a storage position of the toner cartridge relative to the imaging unit with the developer roll of the toner cartridge spaced away from the corresponding photoconductive drum of the imaging unit and with the toner cartridge pivoted about the pivot axis from the operative position of the toner cartridge relative to the imaging unit.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
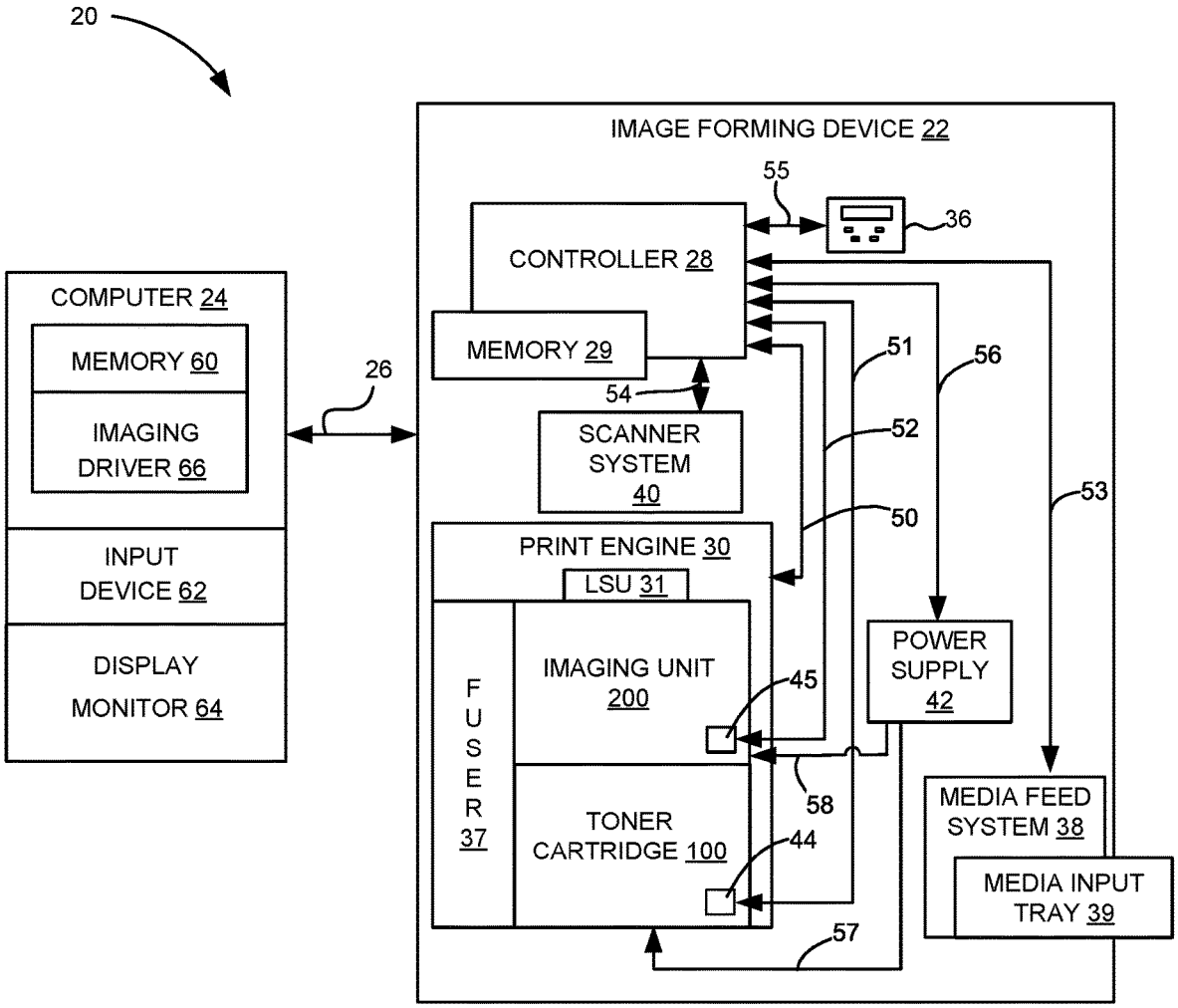
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, an imaging unit 200, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with imaging unit 200 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with power supply 42 via a communications link 56. Controller 28 processes print and scan data and operates print engine 30 during printing and scanner system 40 during scanning. Processing circuitry 44, 45 may provide authentication functions, safety and operational interlocks, operating parameters and usage information related to toner cartridge 100 and imaging unit 200, respectively. Each of processing circuitry 44, 45 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile and/or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Toner cartridge 100 and imaging unit 200 are removably mounted in image forming device 22. Power supply 42 provides an electrical voltage to various components of toner cartridge 100 and imaging unit 200 via respective electrical paths 57 and 58. In one embodiment, toner cartridge 100 includes a developer unit that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of the developer unit is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, the developer unit includes a developer roll that attracts the magnetic carrier beads having toner thereon to the developer roll through the use of magnetic fields. In one embodiment, imaging unit 200 includes a photoconductor unit that houses a charge roll, a photoconductive drum and a waste toner removal system. Although the example image forming device 22 illustrated in FIG. 1 includes one toner cartridge and one imaging unit, in the case of an image forming device configured to print in color, separate toner cartridges and imaging units may be used for each toner color. For example, in one embodiment, the image forming device includes four toner cartridges, each containing a particular toner color (e.g., black, cyan, yellow and magenta) to permit color printing, and four corresponding imaging units.

The electrophotographic printing process is well known in the art and, therefore, is described briefly herein. During a printing operation, laser scan unit 31 creates a latent image on the photoconductive drum in imaging unit 200. Toner is transferred from the toner reservoir in toner cartridge 100 to the latent image on the photoconductive drum by the developer roll to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
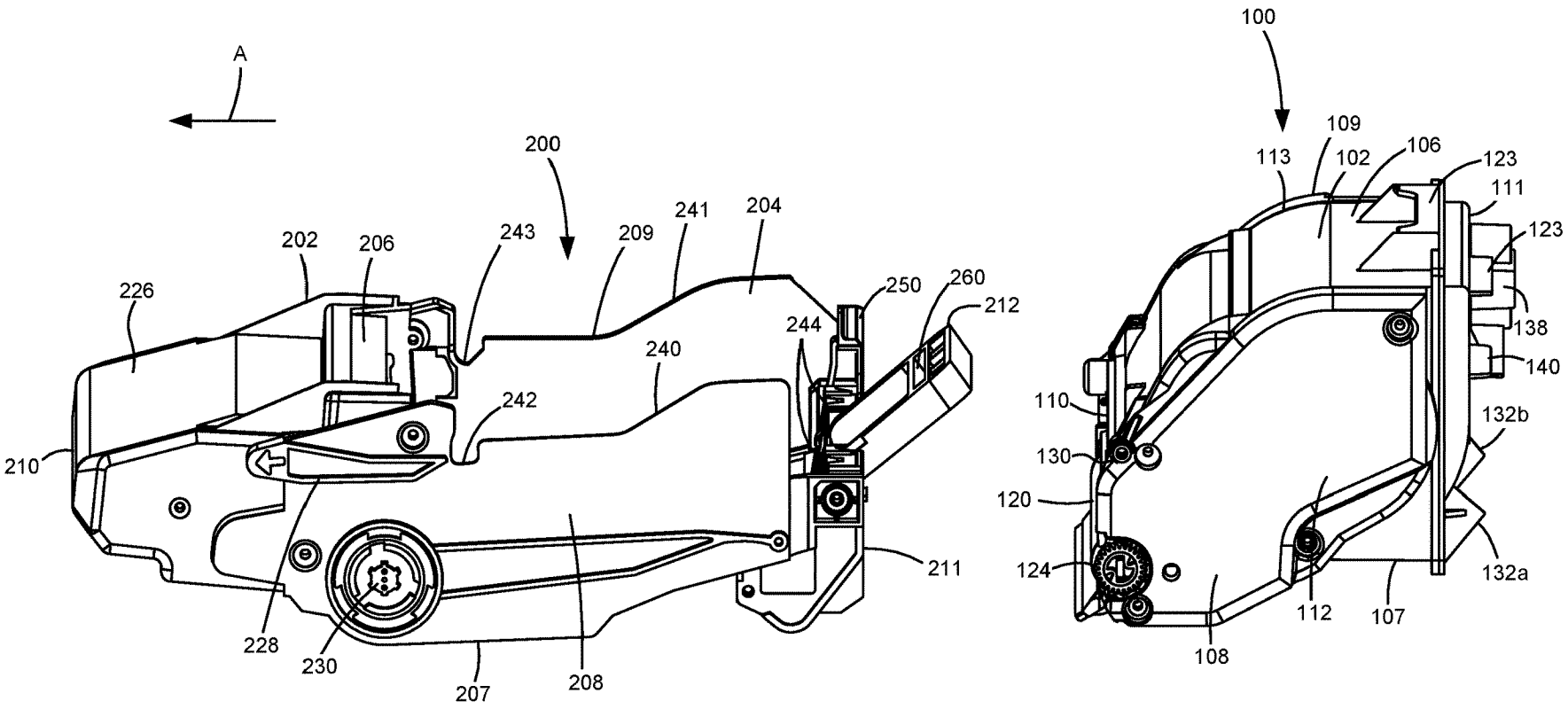
FIG. 2 is a perspective view of a toner cartridge and an imaging unit separated from each other according to one example embodiment.
Figure 3:
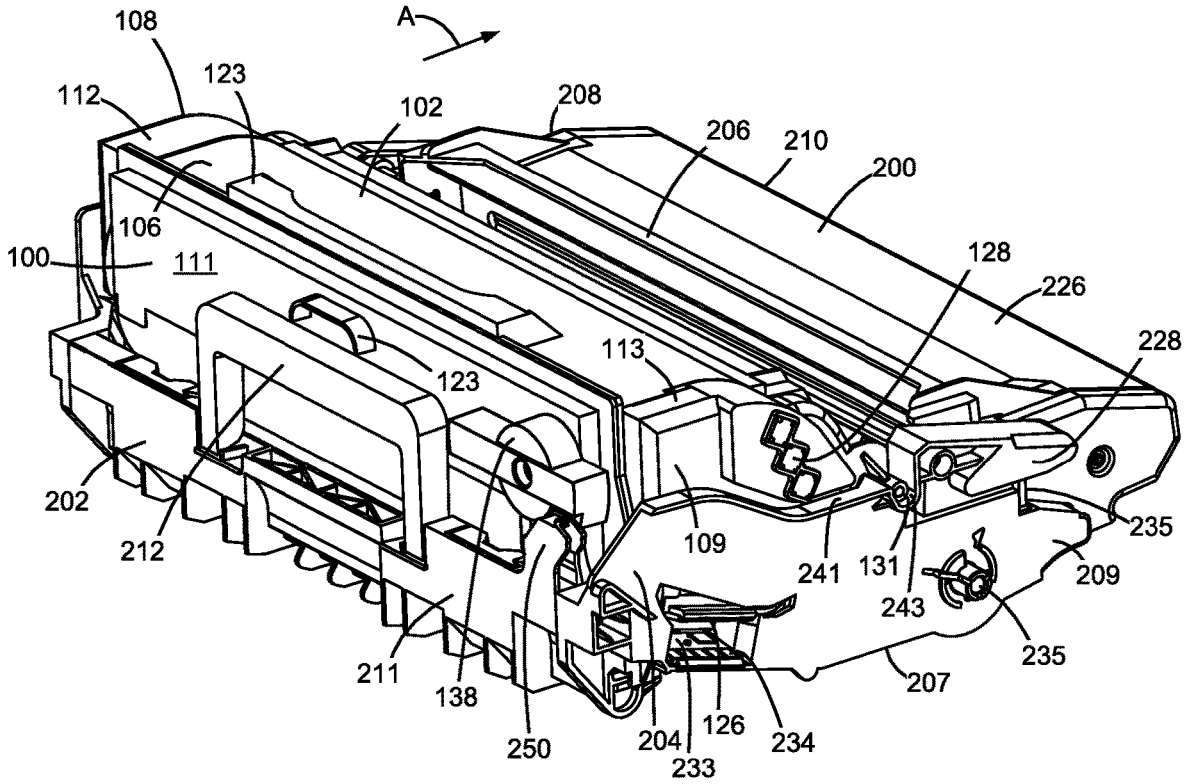
FIG. 3 is a perspective view of the toner cartridge and the imaging unit shown in FIG. 2 mated with each other according to one example embodiment.
Figure 4:
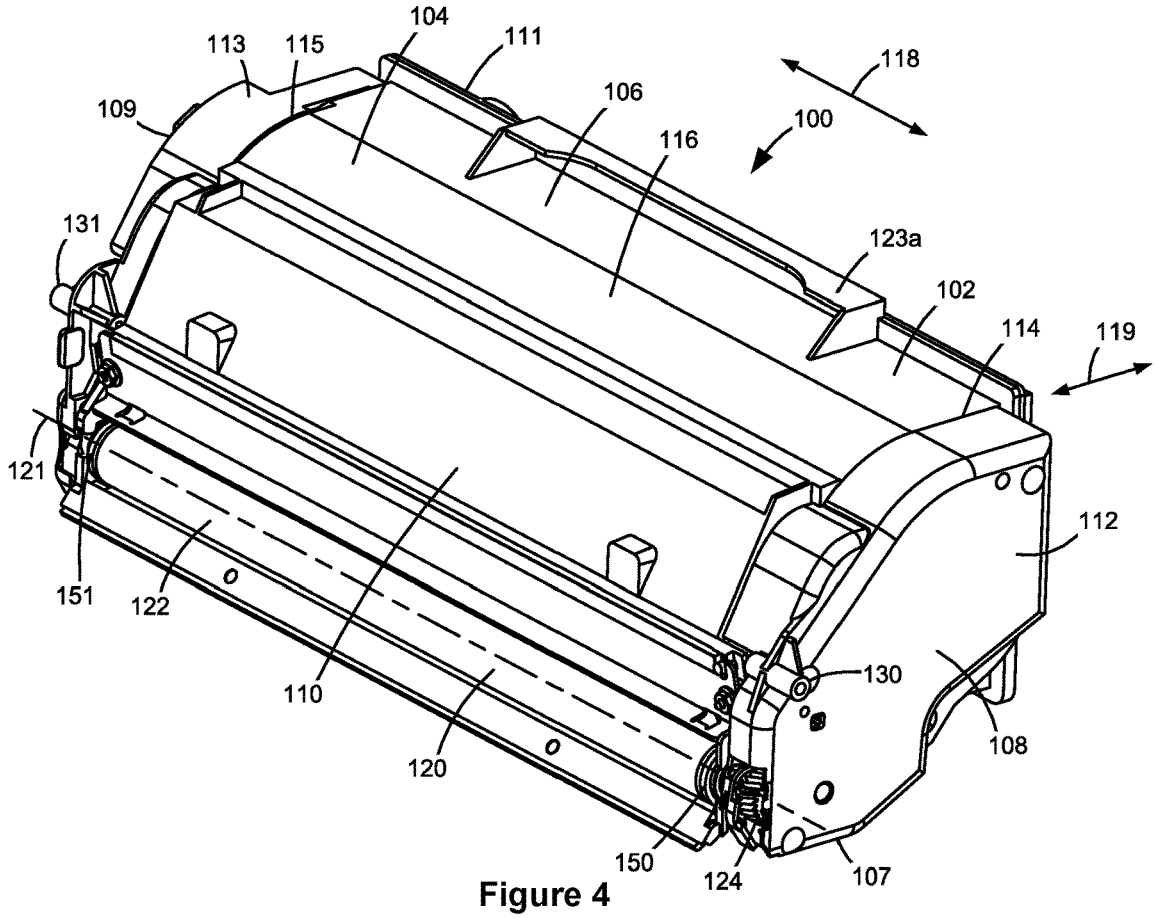
FIG. 4 is a front perspective view of the toner cartridge shown in FIGS. 2 and 3.
Figure 5:
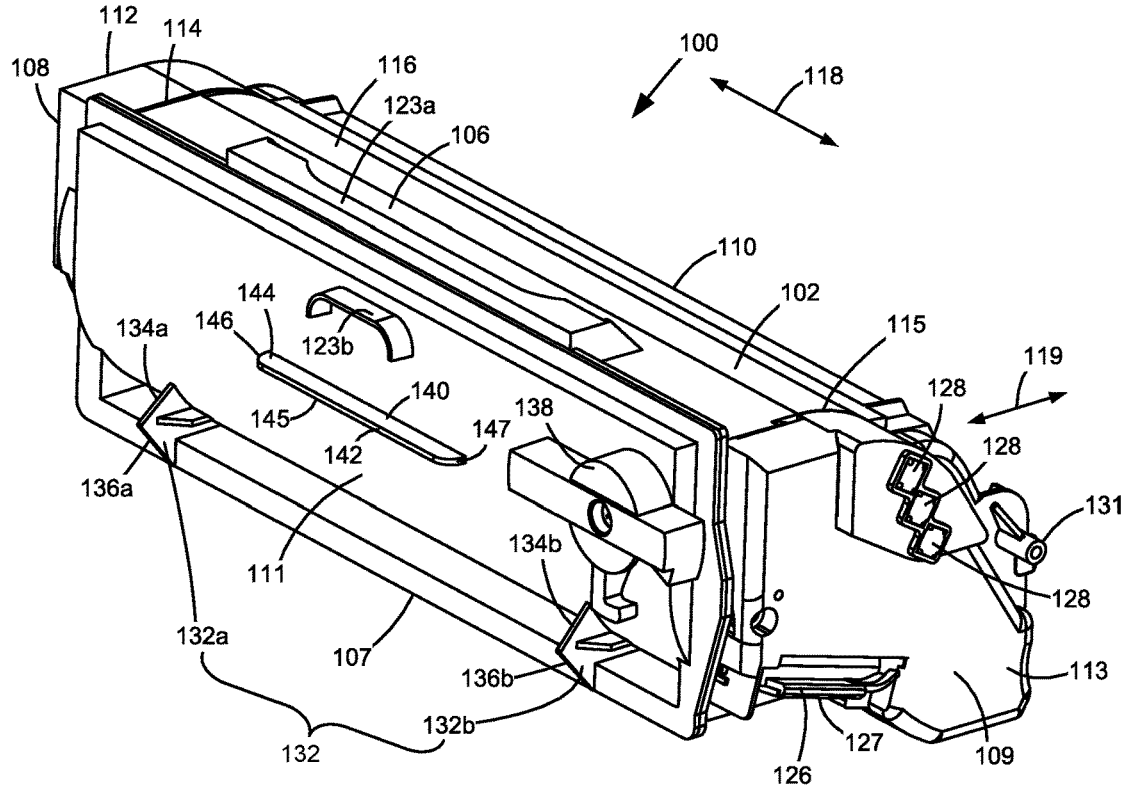
FIG. 5 is a rear perspective view of the toner cartridge shown in FIGS. 2-4.

Referring now to FIGS. 2 and 3, toner cartridge 100 and imaging unit 200 are shown according to one example embodiment. As discussed above, toner cartridge 100 and imaging unit 200 are each removably installed in image forming device 22. Toner cartridge 100 is first installed on a frame 204 of imaging unit 200 and mated with imaging unit 200. Toner cartridge 100 and imaging unit 200 are then slidably inserted together into image forming device 22. FIG. 2 shows toner cartridge 100 and imaging unit 200 separated from each other and FIG. 3 shows toner cartridge 100 installed on imaging unit 200. The arrow A shown in FIGS. 2 and 3 indicates the direction of insertion of toner cartridge 100 and imaging unit 200 into image forming device 22. This arrangement allows toner cartridge 100 and imaging unit 200 to be easily removed from and reinstalled in image forming device 22 as a single unit, while permitting toner cartridge 100 and imaging unit 200 to be repaired or replaced separately from each other.

Figure 6:
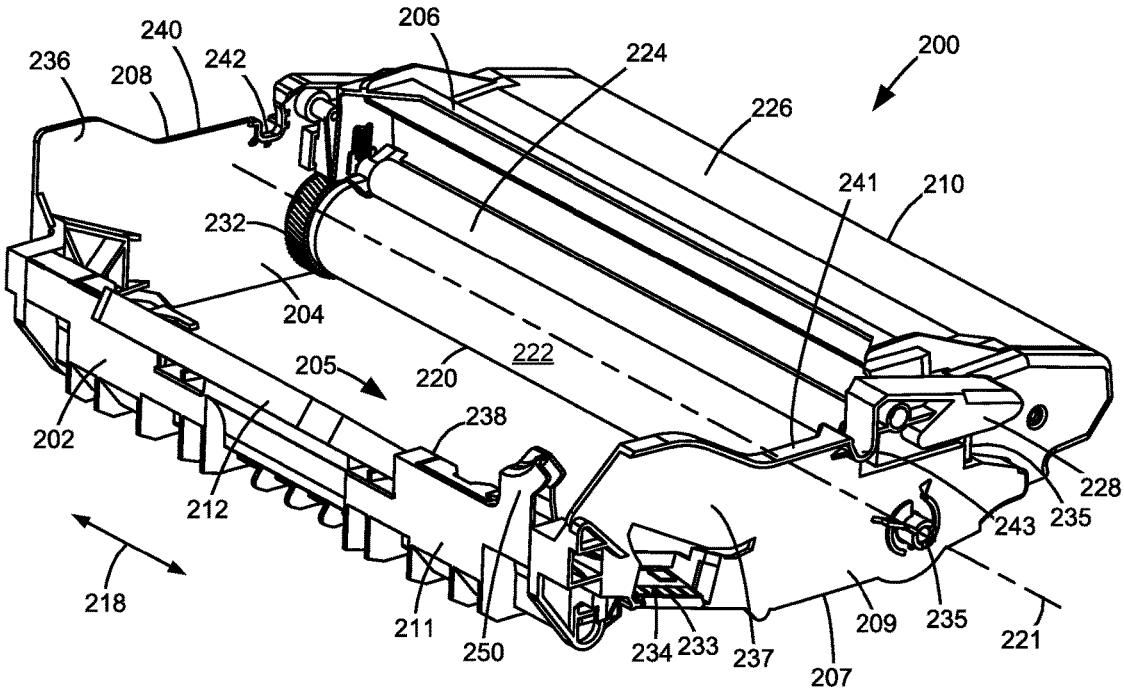
FIG. 6 is a rear perspective view of the imaging unit shown in FIGS. 2 and 3.

With reference to FIGS. 2-5, toner cartridge 100 includes a housing 102 having an enclosed reservoir 104 for storing toner. Housing 102 includes a top 106, a bottom 107, first and second sides 108, 109, a front 110 and a rear 111. Front 110 of housing 102 leads during insertion of toner cartridge 100 into image forming device 22, and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In the example embodiment illustrated, toner cartridge 100 includes a rotatable developer roll 120 having a rotational axis 121 that runs along a side-to-side dimension 118 of housing 102, from side 108 to side 109. A portion of an outer surface 122 of developer roll 120 is exposed from housing 102 along front 110 of housing 102, near bottom 107 of housing 102 for delivering toner from toner cartridge 100 to a corresponding photoconductive drum 220 (FIG. 6) of imaging unit 200. In this manner, developer roll 120 forms an outlet for exiting toner from toner cartridge 100.

A handle 123 may be provided on top 106 and/or rear 111 of housing 102 to assist with coupling and decoupling toner cartridge 100 to and from imaging unit 200 and insertion and removal of toner cartridge 100 and imaging unit 200 into and out of image forming device 22. In the example embodiment illustrated, handle 123 includes a finger grip 123*a* on top 106 of housing 102 and a thumb grip 123*b* on rear 111 of housing 102. In the embodiment illustrated, finger grip 123*a* is centered between sides 108 and 109 and extends along side-to-side dimension 118 of housing 102. In this embodiment, thumb grip 123*b* is centered between sides 108 and 109 and protrudes outward from rear 111 of housing 102. In some embodiments, thumb grip 123*b* is concave downward as shown FIG. 5.

Toner cartridge 100 also includes an interface gear 124 positioned on side 108 of housing 102. In the embodiment illustrated, interface gear 124 mates with and receives rotational force from a corresponding drive gear on imaging unit 200 in order to provide rotational force to developer roll 120 and other rotatable components of toner cartridge 100 for moving toner to developer roll 120 when toner cartridge 100 is installed in image forming device 22. In the embodiment illustrated, interface gear 124 is mounted to a shaft of developer roll 120, coaxial with developer roll 120. In this embodiment, a front portion of interface gear 124 is exposed on the front 110 of housing 102, near bottom 107 of housing 102 and is unobstructed to mate with and receive rotational force from the corresponding drive gear on imaging unit 200. In the embodiment illustrated, interface gear 124 is rotatably connected to a drive train that is positioned between end cap 112 and side wall 114 of housing 102. The drive train aids in transferring rotational force from interface gear 124 to rotatable components of toner cartridge 100, including, for example, to a toner adder roll that provides toner from reservoir 104 to developer roll 120 and to one or more toner agitators that move toner in reservoir 104 toward the toner adder roll and that agitate and mix the toner in reservoir 104. In the example embodiment illustrated, interface gear 124 is formed as a helical gear, but other configurations may be used as desired.

In the embodiment illustrated, toner cartridge 100 also includes an electrical connector 126 positioned on side 109 of housing 102 that includes one or more electrical contacts 127 that mate with corresponding electrical contacts in image forming device 22 when toner cartridge 100 is installed in image forming device 22 in order to facilitate communications link 51 between controller 28 of image forming device 22 and processing circuitry 44 of toner cartridge 100. In the embodiment illustrated, toner cartridge 100 also includes one or more electrical contacts 128 that mate with corresponding electrical contacts in image forming device 22 when toner cartridge 100 is installed in image forming device 22 in order to facilitate electrical path 57 between power supply 42 of image forming device 22 and one or more imaging components of toner cartridge 100 (e.g., developer roll 120, a toner adder roll of toner cartridge 100, and/or a doctor blade of toner cartridge 100).

Toner cartridge 100 also includes an alignment guide 130, 131 extending outward from each side 108, 109 of housing 102. Alignment guides 130, 131 assist with mating toner cartridge 100 to imaging unit 200 and with positioning toner cartridge 100 relative to imaging unit 200 during operation in image forming device 22. Alignment guides 130, 131 are received by corresponding guides on imaging unit 200 that aid in positioning toner cartridge 100 relative to imaging unit 200. Alignment guides 130, 131 are spaced above developer roll 120 along front 110 of housing 102, e.g., at the same height as each other and at the same position along a front-to-rear dimension 119 of housing 102.

Toner cartridge 100 also includes one or more engagement members 132 that receive a bias force from corresponding hold-downs on imaging unit 200 to retain toner cartridge 100 in its operative position on imaging unit 200 during operation. For example, the bias force received by engagement members 132 maintains contact between developer roll 120 and the corresponding photoconductive drum 220 on imaging unit 200 and between interface gear 124 and the corresponding drive gear on imaging unit 200.

In the example embodiment illustrated, engagement members 132 are positioned on rear 111 of housing 102, near bottom 107 of housing 102. The example embodiment illustrated includes a pair of engagement members 132*a*, 132*b*. In the embodiment illustrated, engagement member 132*a* is positioned closer to side 108 than to side 109, and engagement member 132*b* is positioned closer to side 109 than to side 108. In the embodiment illustrated, each engagement member 132*a*, 132*b* is formed as a projection from rear 111 of housing 102, e.g., a substantially vertical fin or wing extending from rear 111 of housing 102. Each engagement member 132*a*, 132*b* includes a contact surface 134*a*, 134*b* that contacts the corresponding hold-down on imaging unit 200 when toner cartridge 100 is installed on imaging unit 200. Contact surfaces 134*a*, 134*b* are angled upward such that each contact surface 134*a*, 134*b* faces upwards and rearwards relative to housing 102, i.e., in a direction toward the top 106 of housing 102 and away from the rear 111 of housing 102 as illustrated. Each engagement member 132*a*, 132*b* may also include an angled lead-in surface 136*a*, 136*b* that facilitates engagement between engagement members 132*a*, 132*b* and the corresponding hold-downs on imaging unit 200. Lead-in surfaces 136*a*, 136*b* are angled downward such that each lead-in surface 136*a*, 136*b* faces downwards and rearwards relative to housing 102, i.e., in a direction toward the bottom 107 of housing 102 and away from the rear 111 of housing 102 as illustrated.

In the embodiment illustrated, toner cartridge 100 also includes a latch 138 on rear 111 of housing 102 that selectably fixes toner cartridge 100 to imaging unit 200 when toner cartridge 100 is installed on imaging unit 200 in order to permit a user to install toner cartridge 100 and imaging unit 200 in image forming device 22 as a single unit and to remove toner cartridge 100 and imaging unit 200 from image forming device 22 as a single unit. Latch 138 is moveable, e.g., rotatable by manual user actuation, between a latching position that fixes toner cartridge 100 to imaging unit 200 by engaging a corresponding latch catch on imaging unit 200 and an unlatching position that permits separation of toner cartridge 100 from imaging unit 200. Separating toner cartridge 100 from imaging unit 200 allows a user to independently repair or replace toner cartridge 100 or imaging unit 200.

Toner cartridge 100 includes an engagement member 140 on rear 111 of housing 102 that is configured to selectably engage a corresponding engagement member on imaging unit 200 in order to physically separate developer roll 120 of toner cartridge 100 from photoconductive drum 220 of imaging unit 200 in order to prevent damage to developer roll 120 and photoconductive drum 220, e.g., during prolonged periods of shipping or storage of image forming device 22 with toner cartridge 100 and imaging unit 200 installed in image forming device 22. During normal operation of image forming device 22, engagement member 140 of toner cartridge 100 may be disengaged from its corresponding engagement member on imaging unit 200.

In the embodiment illustrated, engagement member 140 includes a horizontal rib 142 or other form of projection that protrudes outward in a rearward direction from rear 111 of housing 102. Rib 142 includes a top surface 144 and a bottom surface 145. Rib 142 also includes a first end 146 and a second end 147. In the embodiment illustrated, rib 142 is centered between sides 108, 109 of toner cartridge 100 and is positioned generally midway between top 106 and bottom 107 of housing 102. In the embodiment illustrated, rib 142 is spaced above engagement members 132 on rear 111 of housing 102 and spaced below thumb grip 123*b* on rear 111 of housing 102. While engagement member 140 includes a single rib 142 in the embodiment illustrated, in other embodiments, engagement member 140 may include, for example, a series of two or more horizontal ribs spaced from each other along side-to-side dimension 118.

With reference to FIGS. 2, 3, 6 and 7, imaging unit 200 includes a housing 202 including a top 206, a bottom 207, first and second sides 208, 209, a front 210 and a rear 211. Front 210 of housing 202 leads during insertion of imaging unit 200 into image forming device 22, and rear 211 trails. In the embodiment illustrated, frame 204 includes a toner cartridge receiving area 205 positioned at rear 211 of housing 202. A handle 212 is positioned on rear 211 of housing 202, e.g., on frame 204, to assist with insertion and removal of toner cartridge 100 and imaging unit 200 into and out of image forming device 22. In the embodiment illustrated, handle 212 is pivotable relative to housing 202 about a pivot axis 213.

In the example embodiment illustrated, imaging unit 200 includes a rotatable photoconductive drum 220 having a rotational axis 221 that runs along a side-to-side dimension 218 of housing 202, from side 208 to side 209. A rear portion of photoconductive drum 220 is open to toner cartridge receiving area 205 of frame 204 for receiving toner from outer surface 122 of developer roll 120 of toner cartridge 100. A bottom portion of photoconductive drum 220 is exposed from housing 202 on bottom 207 of housing 202. Toner on an outer surface 222 of photoconductive drum 220 is transferred from the bottom portion of outer surface 222 of photoconductive drum 220 to a media sheet or intermediate transfer member during a print operation. Imaging unit 200 also includes a rotatable charge roll 224 in contact with outer surface 222 of photoconductive drum 220 that charges outer surface 222 of photoconductive drum 220 to a predetermined voltage. Imaging unit 200 also includes a waste toner removal system that may include a cleaner blade or roll that removes residual toner from outer surface 222 of photoconductive drum 220. In the example embodiment illustrated, imaging unit 200 includes a waste toner reservoir 226 positioned at the front 210 of housing 202. Waste toner reservoir 226 stores toner removed from photoconductive drum 220 by the cleaner blade or roll.

Sides 208, 209 may each include one or more alignment guides 228 that extend outward from the respective side 208, 209 to assist with insertion and removal of toner cartridge 100 and imaging unit 200 into and out of image forming device 22. Alignment guides 228 are received by corresponding guide rails in image forming device 22 that aid in positioning toner cartridge 100 and imaging unit 200 relative to image forming device 22.

Imaging unit 200 also includes a drive coupler 230 positioned on side 208 of housing 202. Drive coupler 230 mates with and receives rotational force from a corresponding drive coupler in image forming device 22 in order to provide rotational force to photoconductive drum 220 when imaging unit 200 is installed in image forming device 22. In the embodiment illustrated, drive coupler 230 is positioned at an axial end of photoconductive drum 220, coaxial with photoconductive drum 220. In this embodiment, an outer axial end of drive coupler 230 is exposed on side 208 of housing 202 and is unobstructed to mate with and receive rotational force from the corresponding drive coupler in image forming device 22. In the example embodiment illustrated, drive coupler 230 is configured to receive rotational force at the outer axial end of drive coupler 230, but other configurations may be used as desired. In some embodiments, charge roll 224 is driven by friction contact between the surfaces of charge roll 224 and photoconductive drum 220. In other embodiments, charge roll 224 is connected to drive coupler 230 by one or more gears.

In the embodiment illustrated, imaging unit 200 also includes a drive gear 232 attached to photoconductive drum 220, axially inboard of drive coupler 230. A portion of drive gear 232 is exposed to toner cartridge receiving area 205 of frame 204 permitting interface gear 124 of toner cartridge 100 to mate with drive gear 232 of imaging unit 200 when toner cartridge 100 is installed on frame 204 of imaging unit 200 to permit the transfer of rotational force received by drive coupler 230 of imaging unit 200 to interface gear 124 of toner cartridge 100 by way of drive gear 232 of imaging unit 200.

Imaging unit 200 also includes an electrical connector 233 positioned on a portion of frame 204 on side 209 of housing 202 that includes one or more electrical contacts 234 that mate with corresponding electrical contacts in image forming device 22 when imaging unit 200 is installed in image forming device 22 in order to facilitate communications link 52 between controller 28 of image forming device 22 and processing circuitry 45 of imaging unit 200. Imaging unit 200 also includes one or more electrical contacts 235 that mate with corresponding electrical contacts in image forming device 22 when imaging unit 200 is installed in image forming device 22 in order to facilitate electrical path 58 between power supply 42 of image forming device 22 and one or more imaging components of imaging unit 200 (e.g., photoconductive drum 220 and charge roll 224).

Frame 204 of imaging unit 200 includes opposed side walls 236, 237 positioned at sides 208, 209 of housing 202, respectively, and a rear wall 238 positioned at rear 211 of housing 202. Side walls 236, 237 and rear wall 238 define toner cartridge receiving area 205 of frame 204. In the embodiment illustrated, a guide rail 240, 241 is positioned along a top surface of each side wall 236, 237. Guide rails 240, 241 receive alignment guides 130, 131 of toner cartridge 100 during installation of toner cartridge 100 onto imaging unit 200 and aid in guiding toner cartridge 100 to toner cartridge receiving area 205 of imaging unit 200 including guiding developer roll 120 toward photoconductive drum 220.

An alignment guide 242, 243 is positioned along a top surface of each side wall 236, 237 at a front portion of frame 204. Alignment guides 242, 243 contact corresponding alignment guides 130, 131 of toner cartridge 100 when toner cartridge 100 is installed on imaging unit 200 in order to position toner cartridge 100 relative to imaging unit 200 during operation. In the embodiment illustrated, alignment guides 242, 243 are positioned at the front of guide rails 240, 241. In this embodiment, alignment guides 242, 243 are formed as dwells or depressions that extend downward from guide rails 240, 241.

Frame 204 of imaging unit 200 includes at least one hold-down 244 that contacts and applies a bias force to the engagement member(s) 132 of toner cartridge 100. Hold-downs 244 are positioned at a rear portion of frame 204, such as on an inner side 239 of rear wall 238 of frame 204. The example embodiment illustrated includes a pair of hold-downs 244*a*, 244*b* corresponding to the pair of engagement members 132*a*, 132*b* of toner cartridge 100. In the embodiment illustrated, hold-down 244*a* is positioned closer to side 208 than to side 209 of imaging unit 200, and hold-down 244*b* is positioned closer to side 209 than to side 208 of imaging unit 200. Hold-downs 244*a*, 244*b* are resiliently deflectable relative to frame 204 in order to supply a bias force to corresponding contact surfaces 134*a*, 134*b* of engagement members 132*a*, 132*b* of toner cartridge 100 that is normal to contact surfaces 134*a*, 134*b*. In the embodiment illustrated, each hold-down 244*a*, 244*b* includes a rod 246*a*, 246*b* that is pivotally mounted to rear wall 238 of frame 204 and that is horizontally oriented. However, hold-downs 244*a*, 244*b* may take other suitable shapes and configurations and may be mounted in other orientations as desired. In the embodiment illustrated, each hold-down 244*a*, 244*b* is biased toward photoconductive drum 220 and front 210 of housing 202 by a corresponding spring 248*a*, 248*b* on frame 204.

In the embodiment illustrated, imaging unit 200 includes a latch catch 250 that engages latch 140 on toner cartridge 100 when toner cartridge 100 is installed on imaging unit 200 and latch 140 is in the latching position in order to prevent toner cartridge 100 from separating from imaging unit 200. In the embodiment illustrated, latch catch 250 extends upward from a top portion of rear wall 238 of frame 204.

Figure 7:
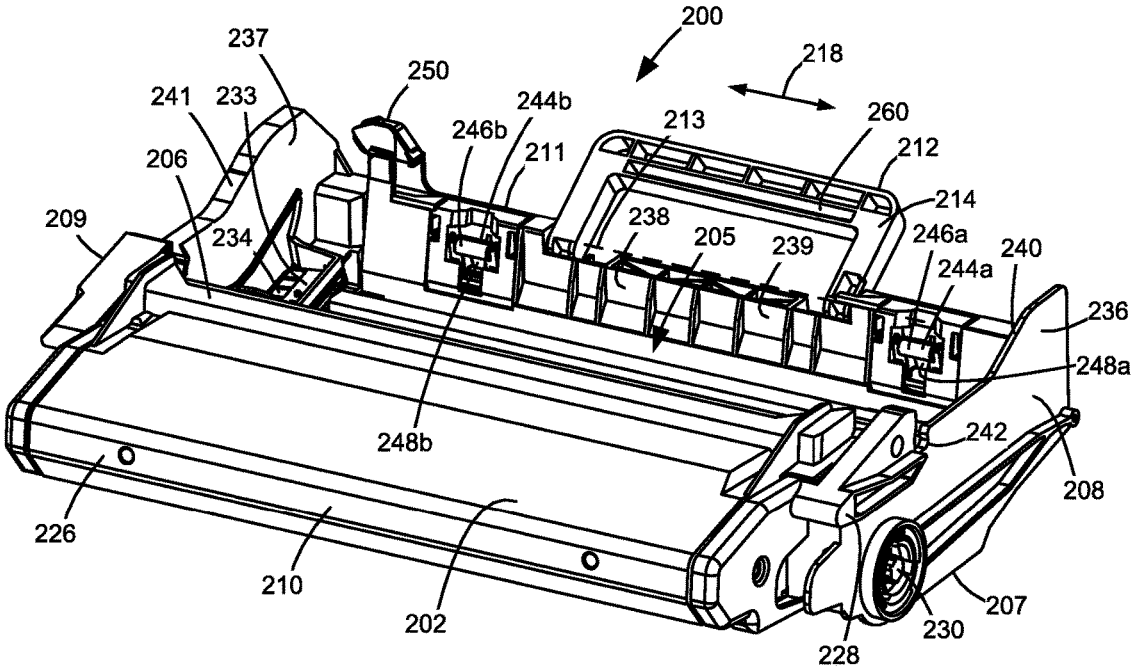
FIG. 7 is a front perspective view of the imaging unit shown in FIGS. 2, 3 and 6.
Figure 8:
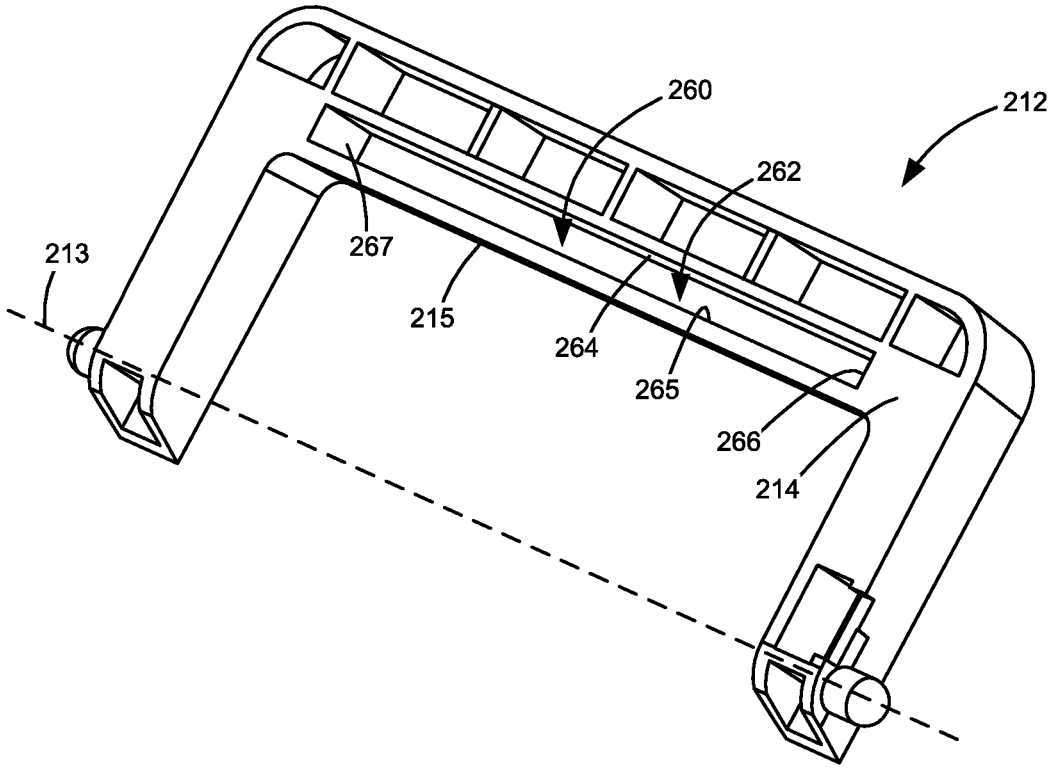
FIG. 8 is a perspective view of a handle of the imaging unit according to one example embodiment.

With reference to FIGS. 7 and 8, imaging unit 200 includes an engagement member 260 positioned at rear 211 of housing 202 that is configured to selectably engage engagement member 140 of toner cartridge 100 in order to physically separate developer roll 120 of toner cartridge 100 from photoconductive drum 220 of imaging unit 200. In the embodiment illustrated, engagement member 260 includes a horizontal slot 262 formed on an inner face 214 of handle 212 of imaging unit 200. As discussed in greater detail below, slot 262 is sized and positioned to receive rib 142 of toner cartridge 100 in order to selectably separate developer roll 120 of toner cartridge 100 from photoconductive drum 220 of imaging unit 200, e.g., during shipping or storage of image forming device 22 with toner cartridge 100 and imaging unit 200 installed in image forming device 22. Slot 262 is defined by a top surface 264, a bottom surface 265 and first and second ends 266, 267. Slot 262 may be formed as a through hole in handle 212 or as a recess on inner face 214 of handle 212 (as illustrated).

Figure 9:
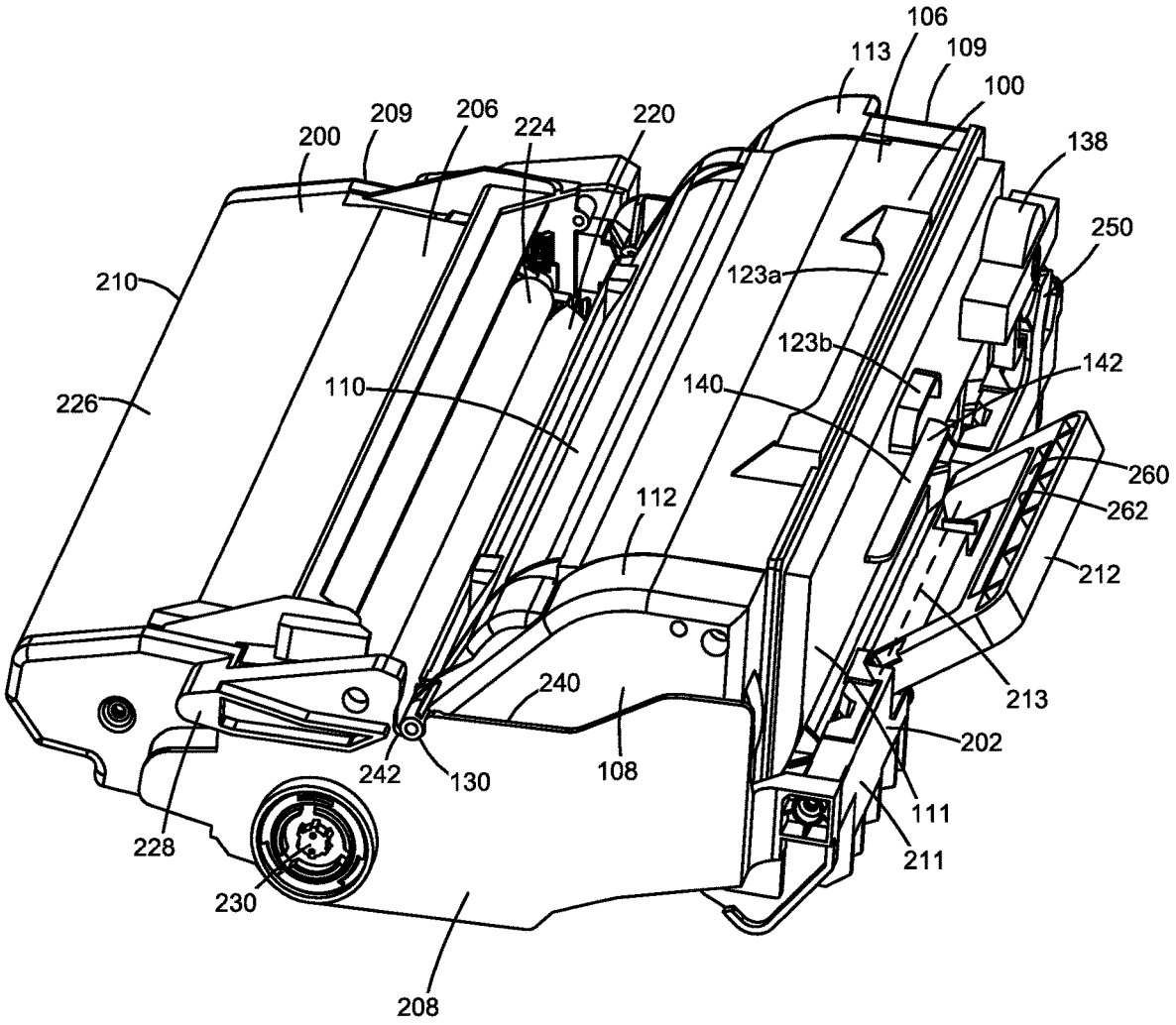
FIG. 9 is a perspective view of the toner cartridge installed on the imaging unit in an operative position of the toner cartridge relative to the imaging unit with the handle of the imaging unit pivoted away from a rear of the toner cartridge according to one example embodiment.
Figure 10:
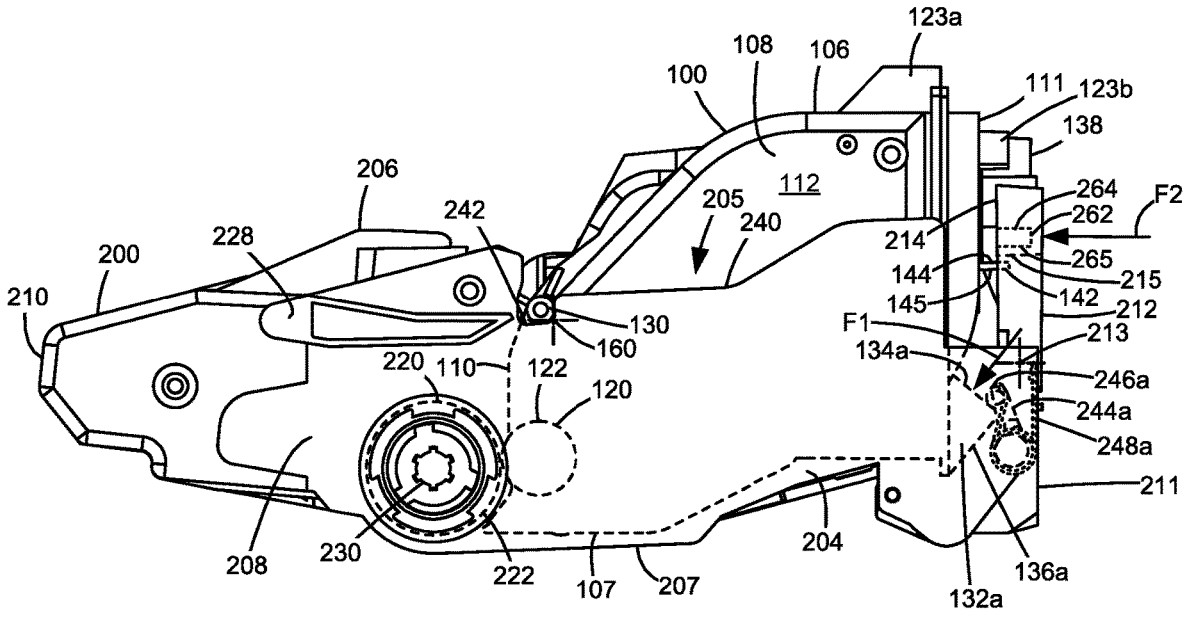
FIG. 10 is a side elevation view of the toner cartridge installed on the imaging unit in the operative position of the toner cartridge relative to the imaging unit with the handle of the imaging unit pivoted against the rear of the toner cartridge according to one example embodiment.
Figure 11:
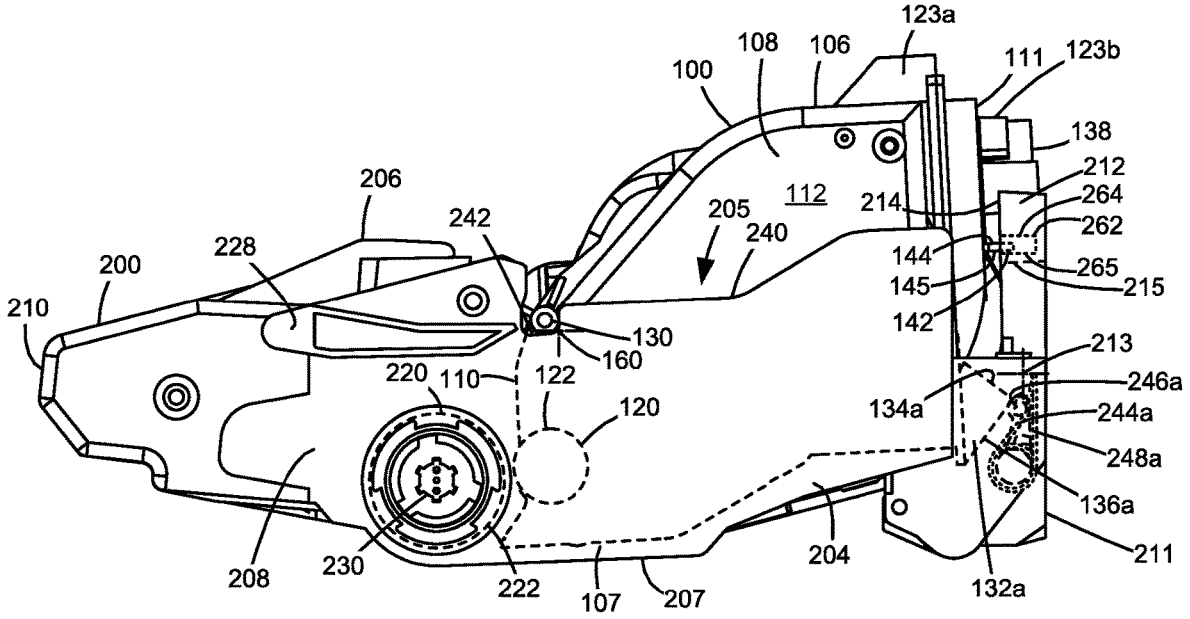
FIG. 11 is a side elevation view of the toner cartridge installed on the imaging unit in a storage position of the toner cartridge relative to the imaging unit with an engagement member of the toner cartridge engaged with a corresponding engagement member of the imaging unit to separate a developer roll of the toner cartridge from a photoconductive drum of the imaging unit according to one example embodiment.

FIGS. 9-11 show toner cartridge 100 installed on imaging unit 200 with engagement member 260 of imaging unit 200 in various positions relative to engagement member 140 of toner cartridge 100. FIG. 9 shows toner cartridge 100 installed on imaging unit 200 with toner cartridge 100 in an operative position relative to imaging unit 200, including with developer roll 120 operatively positioned relative to photoconductive drum 220. In the position shown in FIG. 9, handle 212 of imaging unit 200 is pivoted away from rear 111 of toner cartridge 100 about pivot axis 213 such that engagement member 140 of toner cartridge 100 is separated from engagement member 260 of imaging unit 200. In this position, in the embodiment illustrated, rib 142 of toner cartridge 100 is spaced from slot 262 of imaging unit 200. The separation of engagement member 140 of toner cartridge 100 from engagement member 260 of imaging unit 200 allows a user to grasp handle 212 of imaging unit 200 to remove toner cartridge 100 and imaging unit 200 from image forming device 22 as a single unite or to insert toner cartridge 100 and imaging unit 200 into image forming device 22 as a single unit. The separation of engagement member 140 of toner cartridge 100 from engagement member 260 of imaging unit 200 also allows a user to separate toner cartridge 100 from imaging unit 200, for example, by unlatching latch 138 of toner cartridge 100 to free toner cartridge 100 from imaging unit 200 and by grasping handle 123 of toner cartridge 100 to lift toner cartridge 100 away from imaging unit 200.

FIG. 10 shows toner cartridge 100 installed on imaging unit 200 with toner cartridge 100 in an operative position relative to imaging unit 200, including developer roll 120 operatively positioned relative to photoconductive drum 220. FIG. 10 includes portions of toner cartridge 100 and imaging unit 200 that are otherwise obscured shown in dashed line in order to help illustrate the positional relationship between features of toner cartridge 100 and imaging unit 200. In the embodiment illustrated, when toner cartridge 100 is in an operative position relative to imaging unit 200, outer surface 122 of developer roll 120 is contact with outer surface 222 of photoconductive drum 220 permitting the transfer of toner from outer surface 122 of developer roll 120 to the portions of outer surface 222 of photoconductive drum 220 discharged by laser scan unit 31 during operation. Some embodiments include a spacer 150, 151 (FIG. 4) positioned at each axial end of developer roll 120, axially outboard of the toner carrying portion of developer roll 120, i.e., the portion of developer roll 120 that includes outer surface 122. In these embodiments, spacers 150, 151 contact outer surface 222 of photoconductive drum 220 and maintain a predetermined, fixed amount of interference between developer roll 120 and photoconductive drum 220 in order to control the amount of compression of developer roll 120 during operation and to control the forces on developer roll 120 and photoconductive drum 220 at the nip formed between developer roll 120 and photoconductive drum 220.

When toner cartridge 100 is installed on imaging unit 200, alignment guides 130, 131 contact corresponding alignment guides 242, 243 of imaging unit 200. FIG. 10 shows alignment guide 130 of toner cartridge 100 in contact with corresponding alignment guide 242 of imaging unit 200. The engagement between alignment guide 131 on the opposite side of toner cartridge 100 and corresponding alignment guide 243 of imaging unit 200 may be substantially the same as the engagement between alignment guide 130 and alignment guide 242.

When toner cartridge 100 is installed on imaging unit 200, hold-downs 244*a*, 244*b* of imaging unit 200 contact engagement members 132*a*, 132*b* of toner cartridge 100. When toner cartridge 100 is in an operative position relative to imaging unit 200 as shown in FIG. 10, hold-downs 244*a*, 244*b* each apply a bias force to the contact surface 134*a*, 134*b* of the corresponding engagement member 132*a*, 132*b*. The force applied to engagement members 132*a*, 132*b* by hold-downs 244*a*, 244*b* (indicated by the arrow F1 in FIG. 10) creates a moment on toner cartridge 100 relative to imaging unit 200 that is clockwise as viewed in FIG. 10 about a pivot axis 160 defined by the contact between alignment guides 130, 131 of toner cartridge 100 and corresponding alignment guides 242, 243 of imaging unit 200. This force compresses developer roll 120 against outer surface 222 of photoconductive drum 220 and presses spacers 150, 151 into contact with outer surface 222 of photoconductive drum 220. FIG. 10 shows engagement member 244*a* of imaging unit 200 in contact with corresponding contact surface 134*a* of engagement member 132*a* of toner cartridge 100. The engagement between engagement member 244*b* of imaging unit 200 with corresponding contact surface 134*b* of engagement member 132*b* of toner cartridge 100 may be substantially the same as the engagement between engagement member 244*a* and engagement member 132*a*.

When toner cartridge 100 is installed on imaging unit 200 and the mated toner cartridge 100 and imaging unit 200 are installed in image forming device 22, the closing of an access door of image forming device 22 for operation of image forming device 22 pushes handle 212 of imaging unit 200 toward rear 111 of toner cartridge 100. The force from the closing of access door of image forming device 22 (indicated by the arrow F2 in FIG. 10) causes handle 212 to pivot about pivot axis 213, counterclockwise as viewed in FIG. 10, and holds inner face 214 of handle 212 against rear 111 of toner cartridge 100 during operation of image forming device 22.

When toner cartridge 100 is in an operative position relative to imaging unit 200 as shown in FIG. 10, rib 142 is positioned below a bottom edge 215 of handle 212 of imaging unit 200. Accordingly, when toner cartridge 100 is in an operative position relative to imaging unit 200, handle 212 of imaging unit 200 is nested between rib 142 and thumb grip 123*b* of toner cartridge 100 such that handle 212 is positioned below thumb grip 123*b* of toner cartridge 100 and wraps around ends 146, 147 of rib 142 and above top surface 144 of rib 142. In this position, handle 212 does not affect the contact between developer roll 120 and photoconductive drum 220 allowing outer surface 122 of developer roll 120 to maintain contact with outer surface 222 of photoconductive drum 220 during operation.

FIG. 11 shows toner cartridge 100 installed on imaging unit 200 with toner cartridge 100 in a storage position relative to imaging unit 200, including outer surface 122 of developer roll 120 spaced away from outer surface 222 of photoconductive drum 220. As discussed above, it may be desired to separate developer roll 120 from photoconductive drum 220 during shipping or storage of image forming device 22 with toner cartridge 100 and imaging unit 200 installed in image forming device 22 in order to prevent damage to developer roll 120 and photoconductive drum 220. Like FIG. 10, FIG. 11 includes portions of toner cartridge 100 and imaging unit 200 that are otherwise obscured shown in dashed line in order to help illustrate the positional relationship between features of toner cartridge 100 and imaging unit 200. To position toner cartridge 100 in the storage position shown in FIG. 11 relative to imaging unit 200, such as in preparation for shipping or storage of image forming device 22, toner cartridge 100 is manually rotated about pivot axis 160, counterclockwise as viewed in FIG. 11, to align rib 142 of toner cartridge 100 with slot 262 of imaging unit 200. Once rib 142 is aligned with slot 262, handle 212 of imaging unit 200 is manually rotated about pivot axis 213 toward rear 111 of toner cartridge 100, counterclockwise as viewed in FIG. 11, so that rib 142 of toner cartridge 100 enters slot 262 of imaging unit 200. Handle 212 is pressed against rear 111 of toner cartridge 100 with rib 142 of toner cartridge 100 positioned within slot 262 of imaging unit 200 in order to trap rib 142 within slot 262. In particular, ends 146, 147 of rib 142 are positioned between ends 266, 267 of slot 262, and top and bottom surfaces 144, 145 of rib 142 are positioned between top and bottom surfaces 264, 265 of slot 262.

When handle 212 is positioned against rear 111 of toner cartridge 100 with rib 142 positioned within slot 262, top and bottom surfaces 264, 265 of slot 262 limit rotational movement of toner cartridge 100 relative to imaging unit 200 about pivot axis 160. Specifically, upward rotation of toner cartridge 100 relative to imaging unit 200 about pivot axis 160 is limited by contact between top surface 264 of slot 262 and top surface 144 of rib 142, and downward rotation of toner cartridge 100 relative to imaging unit 200 about pivot axis 160 is limited by contact between bottom surface 265 of slot 262 and bottom surface 145 of rib 142. Depending on the position of hold-downs 244*a*, 244*b* of imaging unit 200 relative to engagement members 132*a*, 132*b* of toner cartridge 100, i.e., whether hold downs 244*a*, 244*b* are in contact with contact surfaces 134*a*, 134*b* of engagement members 132*a*, 132*b* or with lead-in surfaces 136*a*, 136*b* of engagement members 132*a*, 132*b*, rib 142 of toner cartridge 100 may be biased by hold-downs 244*a*, 244*b* toward top surface 264 of slot 262 or toward bottom surface 265 of slot 262. Rib 142 and slot 262 are positioned to ensure that outer surface 122 of developer roll 120 is separated from outer surface 222 of photoconductive drum 220 as shown in FIG. 11 when rib 142 is positioned within slot 262.

In order to move toner cartridge 100 to the operative position relative to imaging unit 200 shown in FIG. 10 from the storage position shown in FIG. 11, handle 212 of imaging unit 200 is manually rotated away from rear 111 of toner cartridge 100, clockwise as viewed in FIGS. 10 and 11. The rotation of handle 212 of imaging unit 200 away from rear 111 of toner cartridge 100 frees rib 142 from slot 262 permitting toner cartridge 100 to rotate relative to imaging unit 200, clockwise as viewed in FIGS. 10 and 11, about pivot axis 160. In some instances, the force applied by hold-downs 244*a*, 244*b* of imaging unit 200 to engagement members 132*a*, 132*b* of toner cartridge 100 may return toner cartridge 100 to the operative position relative to imaging unit 200 once handle 212 is moved away from rib 142 without additional user intervention. Otherwise, toner cartridge 100 is manually pressed downward relative to imaging unit 200 after handle 212 is moved away from rib 142 causing toner cartridge 100 to pivot relative to imaging unit 200, clockwise as viewed in FIGS. 10 and 11, about pivot axis 160 to the operative position of toner cartridge 100 relative to imaging unit 200.

Accordingly, engagement member 140 of toner cartridge 100 and engagement member 260 of imaging unit 200 allow for simple repositioning of toner cartridge 100 relative to imaging unit 200 to separate developer roll 120 of toner cartridge 100 from photoconductive drum 220 of imaging unit 200 as desired, e.g., during storage or shipping of image forming device 22. Once image forming device 22 is ready for operation, engagement member 140 of toner cartridge 100 and engagement member 260 of imaging unit 200 permit a user to easily reposition toner cartridge 100 to its operative position relative to imaging unit 200 for use in image forming device 22. In the example embodiment illustrated, separation of developer roll 120 from photoconductive drum 220 is accomplished by engagement members 140, 260 positioned on toner cartridge 100 and imaging unit 200, rather than through the use of a separate separator component. As a result, the user does not need to remove and discard a separate separator component prior to use of toner cartridge 100 and imaging unit 200 since engagement members 140, 260 are incorporated into toner cartridge 100 and imaging unit 200, respectively.

Although the example embodiment illustrated includes a male engagement member 140 (rib 142) positioned on toner cartridge 100 and a corresponding female engagement member 260 (slot 262) positioned on imaging unit 200, in other embodiments, toner cartridge 100 may include a female engagement member 140 and imaging unit 200 may include a corresponding male engagement member 260 for separating developer roll 120 of toner cartridge 100 from photoconductive drum 220 of imaging unit 200. Other configurations may be used as desired.

Although the example embodiment illustrated includes an engagement member 260 positioned on handle 212 of imaging unit 200, in other embodiments, engagement member 260 is positioned on moveable element of imaging unit 200 other than handle 212, such as, for example, a moveable element solely used for engaging engagement member 260 with engagement member 140 and disengaging engagement member 260 from engagement member 140. Further, while the example embodiment illustrated includes an engagement member 260 positioned on a pivoting handle 212 of imaging unit 200, engagement member 260 may be positioned on a moveable element (such as handle 212 or another moveable element) that is moveable in a manner other than pivoting/rotating, such as, for example, a translatable element or an element that translates and pivots/rotates.

Further, although the example embodiment illustrated includes an engagement member 260 positioned on a moveable element (handle 212) of imaging unit 200 and an engagement member 140 positioned on a stationary element (rear 111) of toner cartridge 100, this configuration may be reversed as desired to include an engagement member 260 positioned on a stationary element of imaging unit 200 and an engagement member 140 positioned on a moveable element of toner cartridge 100. Alternatively, engagement member 140 and engagement member 260 may each be positioned on a moveable element of toner cartridge 100 and imaging unit 200, respectively.

Further, it will be appreciated that the architecture and shape of toner cartridge 100 and imaging unit 200 illustrated is merely intended to serve as an example. Those skilled in the art understand that toner cartridges, imaging units, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An imaging unit for use with a toner cartridge in an electrophotographic image forming device, comprising:

a frame defining a toner cartridge receiving area for receiving the toner cartridge;

a rotatable photoconductive drum, a portion of the photoconductive drum is exposed along a front portion of the toner cartridge receiving area for receiving toner from a corresponding developer roll of the toner cartridge when the toner cartridge is installed on the frame of the imaging unit in the toner cartridge receiving area in an operative position of the toner cartridge relative to the imaging unit; and a first engagement member mounted to the frame, the first engagement member is moveable relative to the frame between a first position and a second position, wherein in the first position, the first engagement member is configured to engage a corresponding second engagement member on the toner cartridge to retain the toner cartridge in a storage position of the toner cartridge relative to the imaging unit with the toner cartridge installed on the frame of the imaging unit in the toner cartridge receiving area and the developer roll of the toner cartridge spaced away from the photoconductive drum, wherein in the second position, the first engagement member is configured to clear the second engagement member on the toner cartridge to permit installation of the toner cartridge on the frame of the imaging unit in the operative position of the toner cartridge relative to the imaging unit and to permit removal of the toner cartridge from the frame of the imaging unit.

2. The imaging unit of claim 1, wherein the first engagement member is positioned along a rear wall of the frame.

3. The imaging unit of claim 1, wherein the first engagement member is pivotable about a pivot axis relative to the frame between the first position and the second position.

4. The imaging unit of claim 1, wherein the first engagement member includes a female engagement member configured to engage a corresponding male engagement member on the toner cartridge when the first engagement member is in the first position to retain the toner cartridge in the storage position of the toner cartridge relative to the imaging unit.

5. The imaging unit of claim 1, wherein the first engagement member is positioned on a handle of the imaging unit that is moveable relative to the frame.

6. The imaging unit of claim 5, wherein the handle is pivotable about a pivot axis relative to the frame.

7. The imaging unit of claim 5, wherein the first engagement member includes a slot on the handle configured to engage a corresponding rib on the toner cartridge when the first engagement member is in the first position to retain the toner cartridge in the storage position of the toner cartridge relative to the imaging unit.

8. An imaging unit for use with a toner cartridge in an electrophotographic image forming device, comprising:

a frame defining a toner cartridge receiving area for receiving the toner cartridge;

a rotatable photoconductive drum, a portion of the photoconductive drum is exposed along a front portion of the toner cartridge receiving area for receiving toner from a corresponding developer roll of the toner cartridge when the toner cartridge is installed on the frame of the imaging unit in the toner cartridge receiving area in an operative position of the toner cartridge relative to the imaging unit;

the frame includes a rear wall positioned along a rear portion of the toner cartridge receiving area; and a handle mounted to the rear wall and pivotable about a pivot axis relative to the rear wall, the handle is positioned to permit a user to grasp the handle to assist with manual insertion of the imaging unit into the image forming device and manual removal of the imaging unit from the image forming device, the handle includes a first engagement member configured to engage a corresponding second engagement member on the toner cartridge to retain the toner cartridge in a storage position of the toner cartridge relative to the imaging unit with the toner cartridge installed on the frame of the imaging unit in the toner cartridge receiving area and the developer roll of the toner cartridge spaced away from the photoconductive drum.

9. The imaging unit of claim 8, wherein the first engagement member includes a slot on the handle configured to engage a corresponding rib on the toner cartridge to retain the toner cartridge in the storage position of the toner cartridge relative to the imaging unit.

10. The imaging unit of claim 9, wherein the slot is formed as a recess in a face of the handle.

11. A toner cartridge for use with an imaging unit in an electrophotographic image forming device, comprising:

a body having a reservoir for storing toner;

a rotatable developer roll mounted on the body and in fluid communication with the reservoir, a portion of an outer surface of the developer roll is exposed along a front of the body for supplying toner from the reservoir to a corresponding photoconductive drum on the imaging unit when the toner cartridge is installed on the imaging unit in an operative position of the toner cartridge relative to the imaging unit; and a first engagement member positioned on a rear of the body, the first engagement member is configured to engage a corresponding second engagement member on the imaging unit when the toner cartridge is installed on the imaging unit to retain the toner cartridge in a storage position of the toner cartridge relative to the imaging unit with the developer roll of the toner cartridge spaced away from the photoconductive drum of the imaging unit.

12. The toner cartridge of claim 11, wherein the first engagement member includes a rib that protrudes outward away from the rear of the body and that is configured to engage a corresponding slot on the imaging unit when the toner cartridge is installed on the imaging unit to retain the toner cartridge in the storage position of the toner cartridge relative to the imaging unit.

13. The toner cartridge of claim 11, further comprising a handle on the rear of the body, wherein the first engagement member is spaced below the handle.

14. The toner cartridge of claim 13, wherein the handle protrudes outward away from the rear of the body and the first engagement member includes a rib that protrudes outward away from the rear of the body.

15. A toner cartridge for use with an imaging unit in an image forming device, comprising:

a body having a top, a bottom, a front and a rear positioned between a first side and a second side of the body, the body has a reservoir for holding toner;

a rotatable developer roll mounted on the body and in fluid communication with the reservoir, a portion of an outer surface of the developer roll is exposed along the front of the body for supplying toner from the reservoir to a corresponding photoconductive drum on the imaging unit when the toner cartridge is installed on the imaging unit in an operative position of the toner cartridge relative to the imaging unit;

a first alignment guide extending outward from the first side of the body and a second alignment guide extending outward from the second side of the body for positioning the toner cartridge on the imaging unit, the first and second alignment guides are spaced above the developer roll along the front of the body, the first and second alignment guides define a pivot axis about which the toner cartridge is pivotable relative to the imaging unit when the toner cartridge is installed on the imaging unit;

an angled contact surface on the rear of the body facing upward and rearward for contacting a corresponding hold-down on the imaging unit and receiving a bias force from the corresponding hold-down on the imaging unit for biasing the toner cartridge about the pivot axis when the toner cartridge is installed on the imaging unit in the operative position of the toner cartridge relative to the imaging unit; and a rib on the rear of the body, the rib protrudes outward away from the rear of the body and is spaced above the angled contact surface, the rib is configured to mate with a corresponding slot on the imaging unit when the toner cartridge is installed on the imaging unit to retain the toner cartridge in a storage position of the toner cartridge relative to the imaging unit with the developer roll of the toner cartridge spaced away from the corresponding photoconductive drum of the imaging unit and with the toner cartridge pivoted about the pivot axis from the operative position of the toner cartridge relative to the imaging unit.

16. The toner cartridge of claim 15, further comprising a thumb grip on the rear of the body that protrudes outward away from the rear of the body, wherein the rib is spaced below the thumb grip.

17. The toner cartridge of claim 16, wherein the thumb grip is concave downward.

* * * * *